US008733474B2

(12) United States Patent
Nikiforuk

(10) Patent No.: US 8,733,474 B2
(45) Date of Patent: May 27, 2014

(54) FLOW CONTROL DIVERTER VALVE

(75) Inventor: Kevin James Nikiforuk, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 585 days.

(21) Appl. No.: 13/007,416

(22) Filed: Jan. 14, 2011

(65) Prior Publication Data

US 2012/0181044 A1 Jul. 19, 2012

(51) Int. Cl.
*E21B 21/10* (2006.01)

(52) U.S. Cl.
USPC ..... 175/57; 175/317; 166/208; 166/374; 166/382; 166/332.4

(58) Field of Classification Search
USPC ..... 175/57, 317; 166/208, 386, 374, 382, 166/332.4
See application file for complete search history.

(56) References Cited

U.S. PATENT DOCUMENTS

| | | | | |
|---|---|---|---|---|
| 3,848,629 | A | 11/1974 | Young | |
| 4,113,012 | A | 9/1978 | Evans et al. | |
| 6,695,066 | B2 * | 2/2004 | Allamon et al. | 166/386 |
| 6,820,697 | B1 * | 11/2004 | Churchill | 166/374 |
| 7,069,991 | B2 * | 7/2006 | Gudmestad et al. | 166/285 |
| 2004/0000406 | A1 * | 1/2004 | Allamon et al. | 166/373 |
| 2005/0072572 | A1 * | 4/2005 | Churchill | 166/319 |
| 2009/0107675 | A1 * | 4/2009 | Eriksen et al. | 166/285 |
| 2012/0018172 | A1 * | 1/2012 | Javed | 166/382 |

FOREIGN PATENT DOCUMENTS

| | | | |
|---|---|---|---|
| WO | WO 2007/083192 | A1 | 7/2007 |
| WO | 2009024753 | A1 | 2/2009 |

OTHER PUBLICATIONS

International Search Report and Written Opinion dated Apr. 20, 2012, International Application No. PCT/CA2012/000038, 9 pages.

* cited by examiner

*Primary Examiner* — Nicole Coy
(74) *Attorney, Agent, or Firm* — Osha • Liang LLP

(57) ABSTRACT

A method of drilling a well and installing a liner includes assembling concentric inner and outer strings of tubulars. A drill bit is located at the lower end of the inner string and a liner with a liner hanger makes up part of the outer string. The inner and outer strings may be rotated in unison to drill the well. A valve is located upstream of a liner hanger control tool used to release and set the liner hanger in the drill string. The valve comprises a ported sleeve that slides relative to a ported housing to meter flow from the interior of the drill string to the annular space. The redirected flow maintains a minimum flow rate in the annular space to prevent cuttings from settling on the control tool. A portion of the valve can further be used with a dart to manipulate downstream equipment.

14 Claims, 5 Drawing Sheets

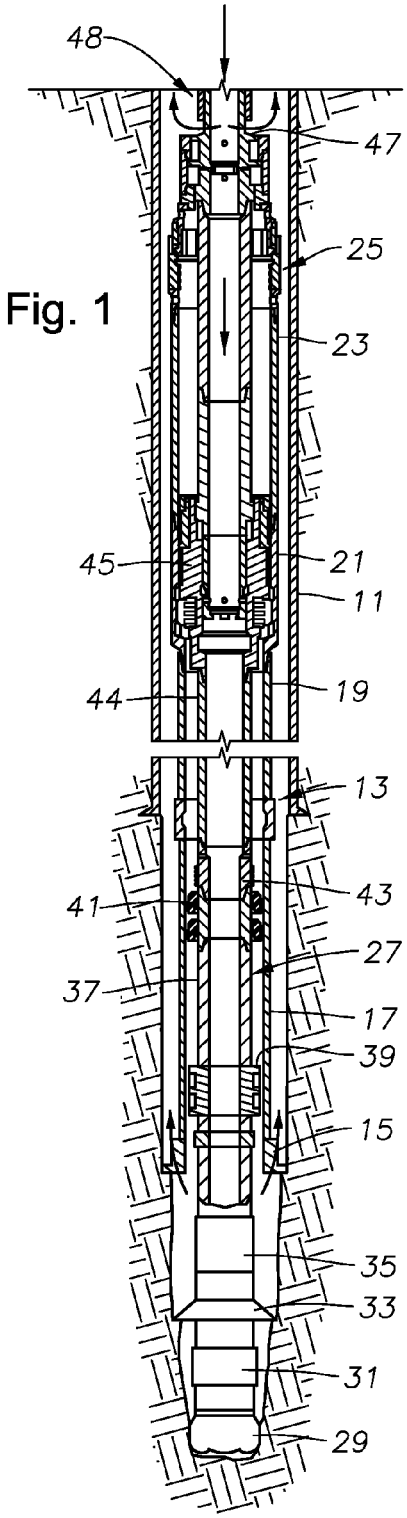
Fig. 1
Fig. 2
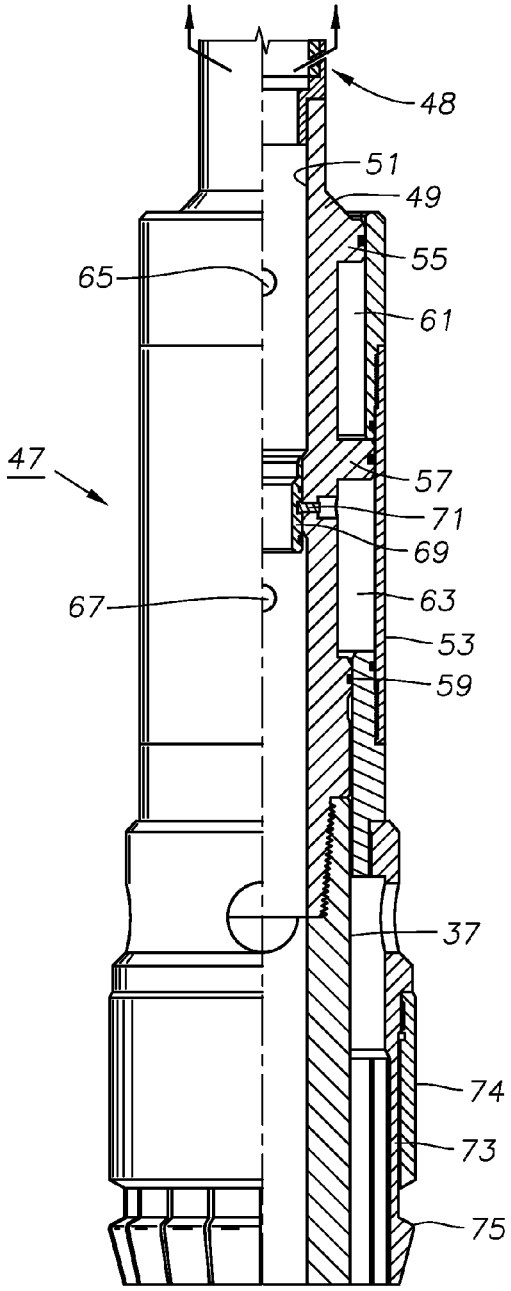

FLOW CONTROL DIVERTER VALVE

FIELD OF THE INVENTION

This invention relates in general to oil and gas well drilling while simultaneously installing a liner in the well bore.

BACKGROUND OF THE INVENTION

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. This method is similar to a related technology known as casing drilling. One technique employs a drill bit on the lower end of the liner. One option is to not retrieve the drill bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits. Retrievable bottom hole assemblies are known for casing drilling, but in casing drilling the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. Typically, in liner drilling, the drill pipe that suspends the liner is much smaller in diameter than the liner and has no room for a bottom hole assembly to be retrieved through it.

During liner drilling, cuttings from the drilling process flow upwards towards the surface in the annular space surrounding the liner. When the cuttings get to the top of the liner where the flow area is much larger, the cuttings tend to settle out on top of the linger hanger running tool due to the decrease in speed of the flow carrying the cuttings. The settled cuttings can cause the running tool to malfunction.

A technique is desired that reduces the settling out of cutting on the liner hanger running tool.

SUMMARY OF THE INVENTION

In an embodiment of the invention, concentric inner and outer strings of tubulars are assembled with a drilling bottom hole assembly located at the lower end of the inner string. The outer string includes a string of liner with a liner hanger at its upper end. The operator lowers the inner and outer strings into the well and rotates the drill bit and an underreamer or a drill shoe on the liner to drill the well. At a selected total liner depth, the liner hanger is set and the inner string is retrieved for cementing. The operator then lowers a packer and a cement retainer on a string of conduit into the well, positions the cement retainer inside the outer string, and engages the packer with the liner hanger. The operator pumps cement down the string of liner and up an outer annulus surrounding the liner. The operator also conveys the cement retainer to a lower portion of the string of liner either before or after pumping the cement. The cement retainer prevents the cement in the outer annulus from flowing back up the string of conduit. The operator then manipulates the conduit to set the packer.

In this embodiment, prior to reaching the selected total depth for the liner, the operator sets the liner hanger, releases the liner hanger running tool, and retrieves the inner string. The liner hanger engages previously installed casing to support the liner in tension. The operator repairs or replaces components of the inner string and reruns them back into the outer string. The operator then re-engages the running tool and releases the liner hanger and continues to rotate the drill bit and underreamer or drill shoe to deepen the well.

Preferably the setting and resetting of the liner hanger is performed by a liner hanger running or control tool mounted to the inner string. In one embodiment, the operator drops a sealing element onto a seat located in the liner hanger control tool. The operator then pumps fluid down the inner string to move a portion of the liner hanger control tool axially relative to the inner string. This movement along with slacking off weight on the inner string results in the liner hanger moving to an engaged position with the casing. The liner hanger is released by re-engaging the liner control tool with the liner hanger, lifting the liner string and applying fluid pressure to stroke the slips of the liner hanger downward to a retracted position.

In another embodiment of the invention, seals are located between the inner string and the outer string near the top and bottom of the liner, defining an inner annular chamber. The operator communicates a portion of the drilling fluid flowing down the inner string to this annular chamber to pressurize the inner chamber. The pressure stretches the inner string to prevent it from buckling. Preferably, the pressure in the annular chamber is maintained even while adding additional sections of tubulars to the inner string. This pressure maintenance may be handled by a check valve located in the inner string.

In an embodiment of the invention, a valve is located in the drill string upstream of the control tool. The valve comprises a housing having threaded connections at each end with a machined internal profile to accept internal components. The valve maintains a minimum flow rate to the downstream side while exhausting excess flow to the outer annular area. In this embodiment, the housing has ports that communicate an inner diameter with an outer diameter of the housing. Further, a sliding ported sleeve is in close reception with the internal profile of the housing and can axially slide relative to the housing. The sleeve may have shear screws or pins at a downstream end that protrude inward to engage a groove formed on an orifice ring located within the sleeve. The shear screws have an appropriate shear value that when sheared release the orifice ring from the sliding sleeve when desired. The orifice ring may have a downstream profile of a "drop ball" for manipulating downstream equipment. Further, a spring element can be seated within a shoulder of the housing to support the sleeve and return the sleeve and orifice assembly to a close position under less than minimum flow conditions. When sufficient flow exists within the drill string, the pressure acting on the orifice ring will compress the spring element to at least partially align the ports of the sleeve and the housing, thereby metering flow outward from the inside of the drill string to the annular space.

During drilling operations, cuttings are lifted to the surface by drilling fluid or mud flowing to the surface in the annular space between casing and liner. The flow directed into the annular space by the valve aids to prevent settling of the cuttings on the liner hanger control tool or running tool.

In another embodiment of the invention, a drop plug is dropped into the drill string and landed on the orifice ring. A circlip is located at a lower extension of the drop plug that passes through an inner diameter of the orifice ring. When sufficient pressure is applied to the drop plug, the shear screws attaching the orifice assembly to the sleeve are sheared, allowing the orifice ring and drop plug to move downstream. The circlip prevents the orifice ring and drop plug from becoming separated when moving downstream. Once the orifice ring is released, the orifice ring can be used to manipulate downstream tools by using the lower profile of the orifice ring as a drop ball.

BRIEF DESCRIPTION OF THE DRAWINGS

FIG. 1 is a schematic sectional view of inner and outer concentric strings during drilling, in accordance with an embodiment of the invention.

FIG. 2 is an enlarged sectional view of a liner hanger control tool of the system of FIG. 1 and shown in a position employed during drilling, in accordance with an embodiment of the invention.

DETAILED DESCRIPTION OF THE INVENTION

Figure 3A:
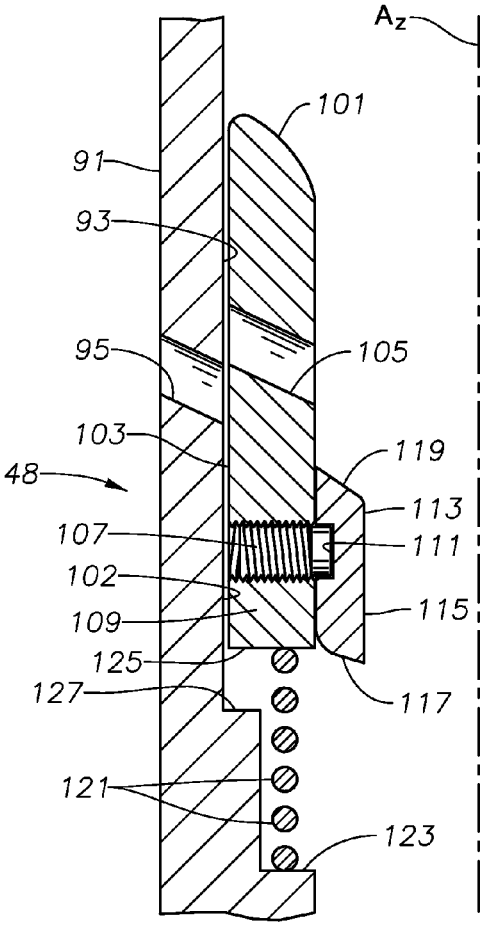
FIG. 3A is an enlarged sectional view of a valve employed in the system of FIG. 1 and shown in a closed position, in accordance with an embodiment of the invention.

Referring to FIG. 1, a well is shown having a casing 11 that is cemented in place. An outer string 13 is located within casing 11 and extends below to an open hole portion of the well. In this example, outer string 13 is made up of a drill shoe 15 on its lower end that may have cutting elements for reaming out the well bore. A tubular shoe joint 17 extends upward from drill shoe 15 and forms the lower end of a string of liner 19. Liner 19 comprises pipe that is typically the same type of pipe as casing, but normally is intended to be cemented with its upper end just above the lower end of casing 11, rather than extending all the way to the top of the well or landed in a wellhead and cemented. The terms "liner" and "casing" may be used interchangeably. Liner 19 may be several thousand feet in length.

Outer string 13 also includes a profile nipple or sub 21 mounted to the upper end of liner 19. Profile nipple 21 is a tubular member having grooves and recesses formed in it for use during drilling operations, as will be explained subsequently. A tieback receptacle 23, which is another tubular member, extends upward from profile nipple 21. Tieback receptacle 23 is a section of pipe having a smooth bore for receiving a tieback sealing element used to land seals from a liner top packer assembly or seals from a tieback seal assembly. Outer string 13 also includes in this example a liner hanger 25 that is resettable from a disengaged position to an engaged position with casing 11. For clarity, casing 11 is illustrated as being considerably larger in inner diameter than the outer diameter of outer string 13, but the annular clearance between liner hanger 25 and casing 11 may be smaller in practice.

An inner string 27 is concentrically located within outer string 13 during drilling. Inner string 27 includes a pilot bit 29 on its lower end. Auxiliary equipment 31 may optionally be incorporated with inner string 27 above pilot bit 29. Auxiliary equipment 31 may include directional control and steering equipment for inclined or horizontal drilling. It may include logging instruments as well to measure the earth formations. In addition, inner string 27 normally includes an underreamer 33 that enlarges the well bore being initially drilled by pilot bit 29. Optionally, inner string 27 may include a mud motor 35 that rotates pilot bit 29 relative to inner string 27 in response to drilling fluid being pumped down inner string 27.

A string of drill pipe 37 is attached to mud motor 35 and forms a part of inner string 27. Drill pipe 37 may be conventional pipe used for drilling wells or it may be other tubular members. During drilling, a portion of drill pipe 37 will extend below drill shoe 15 so as to place drill bit 29, auxiliary equipment 31 and reamer 33 below drill shoe 15. An internal stabilizer 39 may be located between drill pipe 37 and the inner diameter of shoe joint 17 to stabilize and maintain inner string 27 concentric.

Optionally, a packoff 41 may be mounted in the string of drill pipe 37. Packoff 41 comprises a sealing element, such as a cup seal, that sealingly engages the inner diameter of shoe joint 17, which forms the lower end of liner 19. If utilized, pack off 41 forms the lower end of an annular chamber 44 between drill pipe 37 and liner 19. Optionally, a drill lock tool 45 at the upper end of liner 19 forms a seal with part of outer string 13 to seal an upper end of inner annulus 44. In this example, a check valve 43 is located between pack off 41 and drill lock tool 45. Check valve 43 admits drilling fluid being pumped down drill pipe 37 to inner annulus 44 to pressurize inner annulus 44 to the same pressure as the drilling fluid flowing through drill pipe 37. This pressure pushes downward on packoff 41, thereby tensioning drill pipe 37 during drilling. Applying tension to drill pipe 37 throughout much of the length of liner 19 during drilling allows one to utilize lighter weight pipe in the lower portion of the string of drill pipe 37 without fear of buckling. Preferably, check valve 43 prevents the fluid pressure in annular chamber 44 from escaping back into the inner passage in drill pipe 37 when pumping ceases, such as when an adding another joint of drill pipe 37.

Drill pipe 37 connects to drill lock tool 45 and extends upward to a rotary drive and weight supporting mechanism on the drilling rig. Often the rotary drive and weight supporting mechanism will be the top drive of a drilling rig. The distance from drill lock tool 45 to the top drive could be thousands of feet during drilling. Drill lock tool 45 engages profile nipple 21 both axially and rotationally. Drill lock tool 45 thus transfers the weight of outer string 13 to the string of drill pipe 37. Also, drill lock tool 45 transfers torque imposed on the upper end of drill pipe 37 to outer string 13, causing it to rotate in unison.

A liner hanger control tool 47 is mounted above drill lock tool 45 and separated by portions of drill pipe 37. Liner hanger control tool 47 is employed to release and set liner hanger 25 and also to release drill lock tool 45. Drill lock tool 45 is located within profile nipple 21 while liner hanger control tool 47 is located above liner hanger 25 in this example.

A valve 48 is shown upstream of the liner hanger control tool 47. The valve may have threaded ends to connect to the tool or a short distance above tool 47 and may be either retrievable or non-retrievable. The valve 48 is employed to meter flow from within the inner string 27 to the outer annular space to thereby maintain sufficient flow rate in the annular space to prevent cuttings from the drilling operation to settle on the control tool 47. The valve 48 will be discussed in more detail in subsequent sections.

In brief explanation of the operation of the equipment shown in FIG. 1, normally during drilling the operator rotates drill pipe 37 at least part of the time, although on some occasions only mud motor 35 is operated, if a mud motor is utilized. Rotating drill pipe 37 from the drilling rig, such as the top drive, causes inner string 27 to rotate, including drill bit 29. Some of the torque applied to drill pipe 37 is transferred from drill lock tool 45 to profile nipple 21. This transfer of torque causes outer string 13 to rotate in unison with inner string 27. In this embodiment, the transfer of torque from inner string 27 to outer string 13 occurs only by means of the engagement of drill lock tool 45 with profile nipple 21. The operator pumps drilling fluid down inner string 27 and out nozzles in pilot bit 29. The drilling fluid flows back up an annulus surrounding outer string 13.

If, prior to reaching the desired total depth for liner 19, the operator wishes to retrieve inner string 27, he may do so. In this example, the operator actuates liner hanger control tool 47 to move the slips of liner hanger 25 from a retracted position to an engaged position in engagement with casing 11. The operator then slacks off the weight on inner string 27, which causes liner hanger 25 to support the weight of outer string 13. Using liner hanger control tool 47, the operator also releases the axial lock of drill lock tool 45 with profile nipple 21. This allows the operator to pull inner string 27 while leaving outer string 13 in the well. The operator may then repair or replace components of the bottom hole assembly including drill bit 29, auxiliary equipment 31, underreamer 33 and mud motor 35. The operator also resets liner hanger control tool 47 and drill lock tool 45 for a reentry engagement, then reruns inner string 27. The operator actuates drill lock tool 45 to reengage profile nipple 21 and lifts inner string 27, which causes drill lock tool 45 to support the weight of outer string 13 and release liner hanger 25. The operator reengages liner hanger control tool 47 with liner hanger 25 to assure that its slips remain retracted. The operator then continues drilling. When at total depth, the operator repeats the process to remove inner string 27, then may proceed to cement outer string 13 into the well bore.

FIG. 2 illustrates one example of liner hanger control tool 47. In this embodiment, liner hanger control tool 47 has a tubular mandrel 49 with an axial flow passage 51 extending through it. In this embodiment, the valve 48 is shown connected to an upper end of the control tool. Valve 48 is preferably located approximately where the smaller diameter drill pipe 37 joins liner hanger control tool 47. The lower end of mandrel 49 connects to a length of drill pipe 37 that extends down to drill lock tool 45. The upper end of mandrel 49 connects to additional strings of drill pipe 37 that lead to the drilling rig. An outer sleeve 53 surrounds mandrel 49 and is axially movable relative to mandrel 49. In this embodiment, an annular upper piston 55 extends around the exterior of mandrel 49 outward into sealing and sliding engagement with outer sleeve 53. An annular central piston 57, located below upper piston 55, extends outward from mandrel 49 into sliding engagement with another portion of outer sleeve 53. Outer sleeve 53 is formed of multiple components in this example, and the portion engaged by central piston 57 has a greater inner diameter than the portion engaged by upper piston 55. An annular lower piston 59 is formed on the exterior of mandrel 49 below central piston 57. Lower piston 59 sealingly engages a lower inner diameter portion of outer sleeve 53. The portion engaged by lower piston 59 has an inner diameter that is less than the inner diameter of the portion of outer sleeve 53 engaged by upper piston 55.

Pistons 55, 57, 59 and outer sleeve 53 define an upper annular chamber 61 and a lower annular chamber 63. An upper port 65 extends between mandrel axial flow passage 51 and upper annular chamber 61. A lower port 67 extends from mandrel axial flow passage 51 to lower annular chamber 63. A seat 69 is located in axial flow passage 51 between upper and lower ports 65, 67. Seat 69 faces upward and preferably is a ring retained by a shear pin 71.

A collet 73 is attached to the lower end of outer sleeve 53. Collet 73 has downward depending fingers 75. An external sleeve 74 surrounds an upper portion of fingers 75. Fingers 75 have upward and outward facing shoulders and are resilient so as to deflect radially inward. Fingers 75 are adapted to engage liner hanger 25 (FIG. 1). Liner hanger 25 includes a sleeve containing a plurality of gripping members or slips (not shown) for engaging the casing 11 (FIG. 1).

In explanation of the components shown in FIG. 2, liner hanger control tool 47 is shown in a released position. Applying drilling fluid pressure to passage 51 causes pressurized drilling fluid to enter both ports 65 and 66 and flow into chambers 61 and 63. The same pressure acts on pistons 55, 57 and 57, 59, resulting in a net downward force that causes outer sleeve 53 and fingers 75 to move downward to the lower position shown in FIG. 2. In the lower position, the shoulder at the lower end of chamber 61 approaches piston 57 while sleeve 74 transfers the downward force to slips (not shown), maintaining slips in their lower retracted position.

Figure 3B:
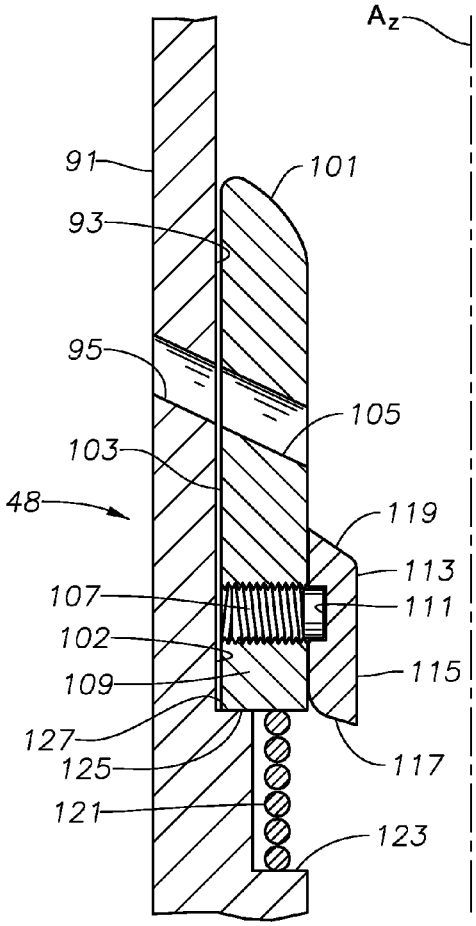
FIG. 3B is an enlarged sectional view of the valve of FIG. 3A shown in an open position, in accordance with an embodiment of the invention.

Referring to FIGS. 3A and 3B, a partial sectional view of the valve 48 connected to an upstream end of the liner hanger control tool 47 is shown. The valve 48 is symmetrical about axis Az. FIG. 3A shows the valve 48 in a closed position while FIG. 3B shows the valve 48 in an open position. The valve 48 also has intermediate positions to allow metering of flow. The valve comprises a housing 91 having threaded connections at each end with a machined internal profile 93 to accept internal components. The valve maintains a minimum flow rate to the downstream side while exhausting excess flow to the outer annular area. In this embodiment, the housing 91 has ports 95 that communicate an inner diameter with an outer diameter of the housing 91. The ports 95 are inclined radially outward in an upstream direction.

Figure 5:
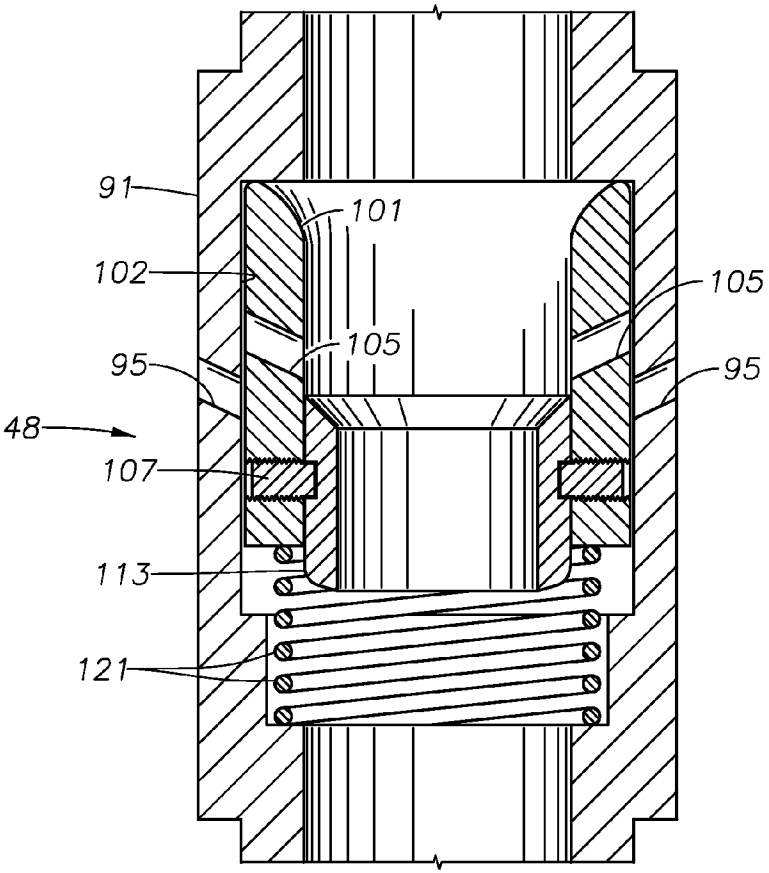
FIG. 5 is a sectional view of the valve of FIGS. 3A, 3B and shown during run-in, in accordance with an embodiment of the invention.
Figure 8:
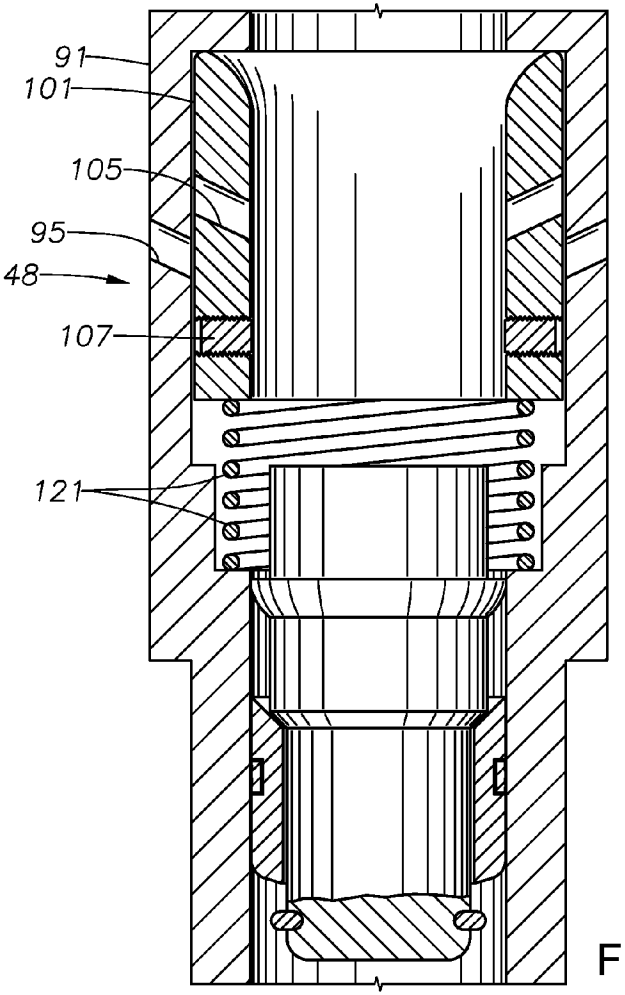
FIG. 8 is a sectional view of the valve of FIGS. 3A, 3B, shown with an orifice ring released from the valve, in accordance with an embodiment of the invention.

Continuing to refer to FIG. 3A, a sleeve 101 is shown within the internal profile 93 of the housing 91 such that an outer surface 103 of the sleeve 101 is in close reception with the internal profile 93. The sleeve 101 can axially slide relative to the housing 91. In this embodiment, the sleeve 101 has ports 105 that communicate an inner diameter with an outer diameter of the sleeve 101. As with the ports 95 on the housing 91, the ports 105 on the sleeve 101 are inclined radially outward in an upstream direction. When the valve 48 is in the closed position shown in FIG. 3A, the ports 105 of the sleeve 101 do not align with the ports 95 of the housing 91. This closed position may be associated to a low flow rate such as 100 GPM or less, depending on the application. When partially or fully open, the sleeve 101 will slide down relative to the housing 91 such that the ports 105 will at least partially align with ports 95 to thereby allow a portion of the fluid flowing in the inner string 27 (FIG. 1) to flow through the ports 105, 95 and into the outer annular space. As an example, the valve may be designed to be partially open when flow rate is approximately 150 GPM and fully open at higher flow rates, such as 200 GPM. In one embodiment, housing 91 has a larger inner diameter than drill pipe 37, defining a recess for sleeve 101. Recess 102 has an upper end and a lower end as shown in FIGS. 3A and 5. In that embodiment, the inner diameter of sleeve 101 is the same as drill pipe 37.

In this embodiment, the sleeve 101 may have shear screws or pins 107 at a downstream end 109 that protrude inward to engage a groove 111 formed on an orifice ring 113 located within the sleeve 101. The orifice ring 113 has a centrally located orifice 115 through which fluid can pass when not obstructed. The diameter of orifice 115 is smaller than the inner diameter of drill pipe 37. The orifice ring 113 may have a partially spherical profile 117 of a "drop ball" on its lower end. Orifice ring 113 may have and a tapered shoulder 119 at an upper end. The shear screws 107 have an appropriate shear value that when sheared release the orifice ring 113 from the sliding sleeve 101 when desired to allow drop ball profile 117 to manipulate downstream equipment. In this embodiment, a spring element 121 can be seated on an upward facing shoulder 123 of the housing 91 to support a lower end 125 of sleeve 101 and return the sleeve 101 and orifice assembly 113 to a close position under less than minimum flow conditions, as shown in FIG. 3A. When sufficient fluid flow exists within the drill string, the pressure acting on the orifice ring 119 will compress the spring element 121 to at least partially align the ports 105 of the sleeve 101 with the ports 95 of the housing 91, thereby metering fluid flow outward from the inner string 27 to the annular space. After orifice ring 113 has sheared and moved below valve 48, spring 121 will return sleeve 101 to the closed position. Because the inner diameter of sleeve 101 is the same as drill pipe 37, it does not provide a reduced diameter orifice that would result in a downward force on sleeve 101. Compression of the spring element 121 and thus downward movement of the sleeve 101 is limited by a stop shoulder 127 formed on the inner profile 93 of the housing 91. The stop shoulder 127 may contact the downstream end 125 of the sleeve 101 at higher flow conditions. Valve 48 maintains a minimum flow rate down drill pipe 37 because it is flow dependent and thus restrictions downstream do not affect the metered flow. Further, a plurality of valves 48 may be located at different points along the drilling assembly to stage flow into the annular area.

Figure 4:
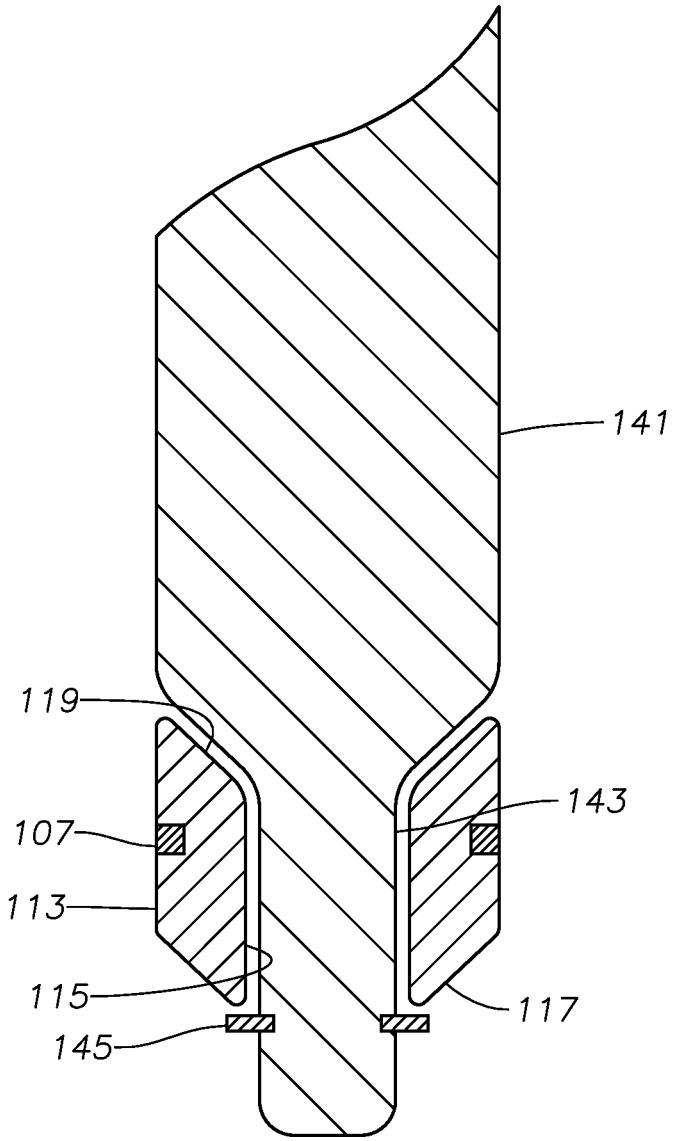
FIG. 4 is a partial sectional view of a drop plug landed on an orifice ring of the valve shown in FIGS. 3A and 3B, in accordance with an embodiment of the invention.

Referring to FIG. 4, a drop plug 141 is shown that may be dropped into the inner string 27 and landed on the orifice ring 113. The drop plug 141 has a lower extension 143 that passes sealingly through the orifice 115 of the orifice ring 113. In this embodiment, a tapered portion above the lower extension 143 corresponds to the tapered upper surface 119 of the orifice ring 113. The drop plug 141 is solid and thus prevents flow through the orifice ring 113 landed. This allows fluid pressure to be increased on the drop plug and generate sufficient force to shear the shear screws 107, allowing the orifice ring 113 and drop plug 141 to move downstream in unison and manipulate downstream equipment with its downstream drop ball profile 117. A circlip 145 may be located at the lower extension 143 of the drop plug 141 to prevent the orifice ring 113 and drop plug 141 from becoming separated when moving downstream.

In the operation of the embodiment shown in FIGS. 1-8, the operator would normally first assemble and run liner string 19 and suspend it at the rig floor of the drilling rig. The operator would make up the bottom hole assembly comprising drill bit 29, auxiliary equipment 31 (optional), reamer 33 and mud motor 35 (optional), check valve 43, and packoff 41 and run it on drill pipe 37 into outer string 13. When a lower portion of the bottom hole assembly has protruded out the lower end of outer string 13 sufficiently, the operator supports the upper end of drill pipe 37 at a false rotary on the rig floor. Thus, the upper end of liner string 19 will be located at the rig floor as well as the upper end of drill pipe 37. Preferably, the operator preassembles an upper assembly to attach to liner string 19 and drill pipe 37. The preassembled components include profile nipple 21, tieback receptacle 23 and liner hanger 25. Drill lock tool 45 and liner hanger control tool 47 as well as intermediate section of drill pipe 37 would be located inside. Drill lock tool 45 would be axially and rotationally locked to profile nipple 21. The operator picks up this upper assembly and lowers it down over the upper end of liner 19 and the upper end of drill pipe 37. The operator connects the upper end of drill pipe 37 to the lower end of housing 81 (FIG. 4) of drill lock tool 45. The operator connects the lower end of profile nipple 21 to the upper end of liner 19.

The operator then lowers the entire assembly in the well by adding additional joints of drill pipe 37. The weight of outer string 13 is supported by the axial engagement between profile nipple 21 and drill lock tool 45. When on or near bottom, the operator pumps drilling fluid through drill pipe 37 and out drill bit 29, which causes drill bit 29 to rotate if mud motor 35 (FIG. 1) is employed. The operator may also rotate drill pipe 37. As shown in FIG. 2, the drilling fluid pump pressure will exist in both upper and lower chamber 61, 63, which results in a net downward force on sleeve 74. Sleeve 74 will be in engagement with the upper ends of slips (not shown) of liner hanger 25, maintaining slips in the retracted position.

During run-in of the drilling assembly, as shown in FIG. 5, flow through the inner string 27 may be at minimum to no flow. Thus, the spring element 121 will maintain the sleeve 101 in the closed position, with the ports 105 not aligned with ports 95 of the housing 91. When inner string 27 is to be retrieved, the dart plug 141 (FIG. 4) may be landed on the orifice ring 113. The dart plug 141 is solid and may have a cup seal 151 for sealing against the inner diameter of the sleeve 101. When pressure is applied to the dart plug 141, sufficient force may be generated to cause the shear screws 107 to shear, releasing the orifice ring 113 from the sleeve 101. This allows the orifice ring 101 and the dart plug 141 to move downstream to manipulate downstream equipment with the drop ball downstream profile 117 of the orifice ring 113.

Figure 6:
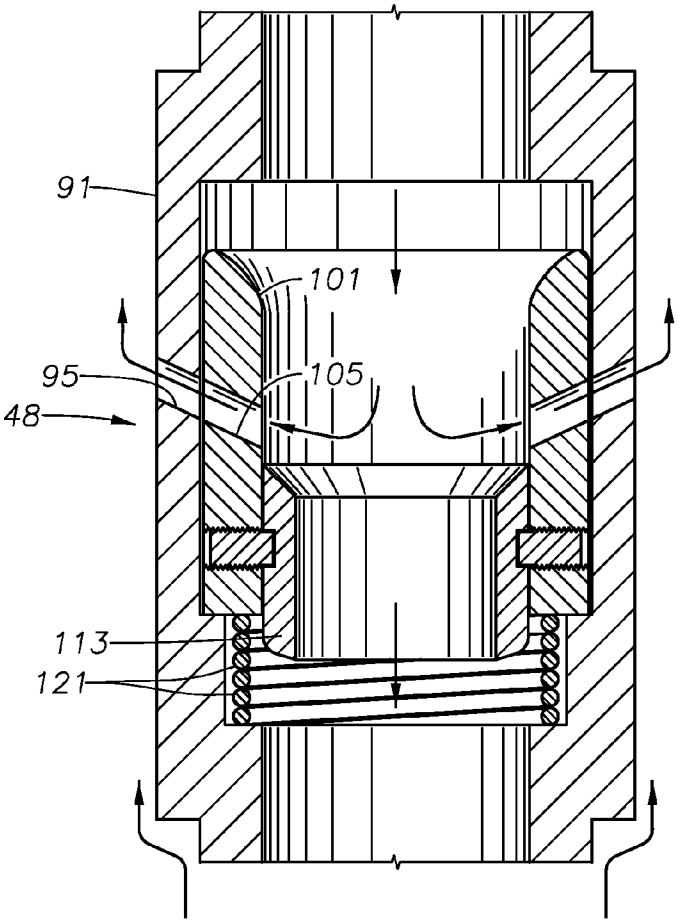
FIG. 6 is a sectional view of the valve of FIGS. 3A, 3B and shown during drilling, in accordance with an embodiment of the invention.

During drilling operations the operator may start pumping drilling fluid through inner string 27, as shown in FIG. 6. Cuttings are typically lifted to the surface by drilling fluid or mud flowing to the surface in the outer annular space. The flow directed into the annular space by the valve 48 aids to prevent settling of the cuttings on the liner hanger control tool or running tool 47. The fluid pressure acting on the orifice ring 113, which is connected to the sleeve 101 by the shear screws 107, is sufficient to overcome the spring element 121 and thereby cause the sleeve 101 and orifice ring 113 to move in a downward direction. Depending on the amount of flow to be metered out into the annular space, the ports 105 of the sleeve 101 will partially or completely align with the ports 95 of the housing 91.

Figure 7:
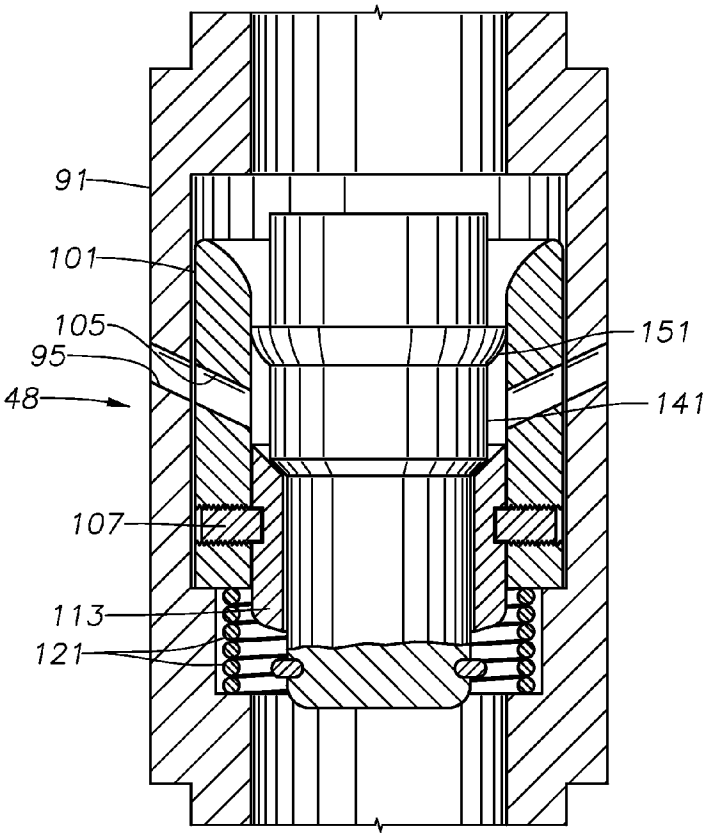
FIG. 7 is a sectional view of the valve of FIGS. 3A, 3B with a plug landed, in accordance with an embodiment of the invention.

While drilling, if it is desired to repair or replace portions of the bottom hole assembly, the operator drops sealing element 141 down drill pipe 37. As illustrated in FIG. 7, sealing element 141 and orifice ring 113 lands on seat 69 in liner hanger control tool 47. The drilling fluid pressure now communicates only with upper chamber 61 because sealing element 141 is blocking the entrance to lower port 67. This results in upward movement of outer sleeve 53 and fingers 75 relative to mandrel 49, causing liner hanger slips (not shown) to move to the set or extended position in contact with casing 11 (FIG. 1). The operator slacks off weight on drill pipe 37, which causes the liner hanger slips to grip casing 11 and support the weight of outer string 13.

The operator may also increases the pressure of the drilling fluid in drill pipe 37 above sealing element 141 to a second level to put the tool 47 in a released position. This increased pressure shears seat 69, causing sealing element 141 and seat 69 to move downward out of liner hanger control tool 47. When in the released position, the drilling fluid flow will be bypassed around sealing element 114 and flow downward and out pilot bit 29 (FIG. 1). The operator may pull the inner string 27 from the well, leaving outer string 13 suspended by liner hanger 25. If no reentry is desired, the operator would then proceed to cementing. If running inner string 27 back, orifice sleeve 113 would be again connected to sleeve 101 by sleeve pins 107. Well control tool 47 would also be reset.

While the invention has been shown in only a few of its forms, it should be apparent to those skilled in the art that it is not so limited but susceptible to various changes without departing from the scope of the invention. For example, the valve may also be employed in liner drilling that does not involve retrieving a bottom hole assembly.

The invention claimed is:

1. An apparatus for drilling a well with a liner string, comprising:

a liner hanger adapted for supporting liner string within a well;

a running tool connected to the liner hanger for running and setting the liner hanger into the well and adapted to connect with a drill string through which drilling fluid flows during drilling operations; and a valve located above the running tool for diverting a portion of drilling fluid flow from within a drill pipe of the drill pipe string to an outer annular space, the valve including:

a housing for connection at the drill string;

a sleeve located within the housing, the sleeve axially movable relative to the housing from a closed position to a fully open position and to intermediate positions between the closed and fully open position in proportion to the rate of drilling fluid flowing through the valve; and an orifice ring coupled to an inner diameter of the sleeve through a shearing member.

2. The apparatus according to claim 1, wherein the valve further comprises:

at least one port formed in the housing that communicates an inner diameter with an outer diameter of the housing;

at least one port formed in the sleeve that communicates fluid from an inner diameter of the sleeve with an outer diameter of the sleeve, wherein the port of the sleeve at least partially aligns with the port of the housing when the sleeve is in metered position to allow fluid to flow from within sleeve to an outer annular space, and the sleeve blocking the port of the housing when sleeve is in closed position; and a spring element within the housing that biases the sleeve to the closed position.

3. The apparatus according to claim 2, wherein the housing has an annular inner recess and the sleeve is located within the recess; and an inner diameter of the sleeve is the same as the inner diameter of the housing above and below the sleeve.

4. The apparatus according to claim 1, wherein the valve further comprises:

at least one port formed in the housing that communicates an inner diameter with an outer diameter of the housing;

at least one port formed in the sleeve that communicates fluid from an inner diameter of the sleeve with an outer diameter of the sleeve, wherein the port of the sleeve at least partially aligns with the port of the housing when the sleeve is in metered position to allow fluid to flow from within sleeve to an outer annular space, and the sleeve blocking the port of the housing when sleeve is in closed position;

a spring element within the housing that biases the sleeve to the closed position; and an orifice within the orifice ring sized such that downward flow within the drill string exerts a downward force on the orifice ring to move the sleeve downward to the metered position.

5. The apparatus according to claim 4, wherein the orifice is located with the orifice ring wherein a sealing object may be dropped through the drill string and land sealingly on the orifice ring, enabling fluid pressure to be applied to the drill string to shear the orifice ring from the sleeve, and wherein lower end of the orifice ring has a partially spherical contour.

6. The apparatus according to claim 5, wherein a plug having a lower extension with an outer diameter corresponding to a diameter of the orifice in the orifice ring is landed on the orifice ring such that the lower extension extends beyond the orifice, when pressure is applied to the plug, the pressure causes the fasteners connecting the orifice ring to the sleeve to shear and thereby release the orifice ring and allow it to move downstream.

7. The apparatus according to claim 6, wherein a retainer ring is located at a lower end of the lower extension that snaps past the orifice of the orifice ring as the plug lands to prevent the plug from separating from the orifice ring as the orifice ring and plug move downward.

8. A method of drilling a well and installing a liner, comprising:

(a) assembling concentric inner and outer strings of tubulars, with a drill bit located at a lower end of the inner string and a string of liner with a liner hanger at its upper end comprising the outer string;

(b) lowering the inner and outer strings into the well on a drill string and rotating the drill bit to drill the well;

(c) pumping fluid down the inner string of tubulars during drilling of the well through a valve having an axially movable sleeve and an orifice ring coupled to an inner diameter of the sleeve through a shearing member, the pumping fluid through the valve including applying a fluid pressure on the orifice ring to move the axially movable sleeve; and (d) metering a portion of the fluid flowing down the drill string through the valve to an outer annular space surrounding the drill string to maintain a minimum flow rate in the annular space to prevent settling of drill cuttings.

9. The method of claim 8, wherein the flow rate of fluid being metered to the annular space is proportional to the flow rate of the fluid pumped down the drill string.

10. The method of claim 8, wherein step (d) comprises the valve in the drill string having a port to the annular space fully and partially open positions in response to the flow rate of the fluid being pumped down the drill string.

11. The method of claim 10, further comprising;

dropping a sealing object down the drill string;

landing the sealing object in the valve and applying fluid and close pressure in the drill string to cause the sealing object to disable the valve and open a passage through the valve at least equal to an inner diameter of the drill string.

12. The method of claim 11, step (b) comprises attaching a running tool between the drill string and the liner; and causing the sealing object and a portion of the valve to move downward, after the valve is disabled, into a seat in the running tool; and applying fluid pressure to cause the running tool to perform a specified function.

13. The method of claim 12, wherein the specified function comprises setting a liner hanger of the liner and releasing the running tool from the liner hanger.

14. The method of claim 10, wherein the valve is biased to a closed position and the valve has an orifice within the orifice ring having a smaller cross-sectional flow area than the drill string, such that downward flowing fluid flowing through the orifice exerts a downward force to open the valve.

* * * * *